US006918226B2

(12) United States Patent
Heilman et al.

(10) Patent No.: US 6,918,226 B2
(45) Date of Patent: Jul. 19, 2005

(54) AUTOMATIC UTENSIL WRAPPING MACHINE

(76) Inventors: Rebecca A. Heilman, 100 Osprey Ridge Way, Ponte Vedra Beach, FL (US) 32082; Eric A. Heilman, 100 Osprey Ridge Way, Ponte Vedra Beach, FL (US) 32082; Andre LeBlanc, 659 Candle Way, Saskatoon, Saskatchewan (CA)

( * ) Notice: Subject to any disclaimer, the term of this patent is extended or adjusted under 35 U.S.C. 154(b) by 0 days.

(21) Appl. No.: 10/611,964

(22) Filed: Jul. 3, 2003

(65) Prior Publication Data

US 2005/0000191 A1 Jan. 6, 2005

(51) Int. Cl.[7] ..... B65B 11/04

(52) U.S. Cl. ..... 53/211; 53/466; 53/203; 53/209; 53/461; 53/216; 53/224; 53/228; 53/232

(58) Field of Search ..... 53/211, 461, 466, 53/203, 209, 216, 224, 228, 232, 399

(56) References Cited

U.S. PATENT DOCUMENTS

| | | | | |
|---|---|---|---|---|
| 3,659,394 A | | 5/1972 | Hartleib et al. | |
| 5,237,801 A | * | 8/1993 | Hillam et al. | 53/446 |
| 5,469,688 A | | 11/1995 | Dunbar et al. | |
| 6,023,908 A | * | 2/2000 | Vetsch | 53/155 |
| 6,023,913 A | | 2/2000 | Gray et al. | |
| 6,202,387 B1 | * | 3/2001 | Brown et al. | 53/419 |
| 6,615,566 B2 | * | 9/2003 | Heisey | 53/466 |
| 2002/0112445 A1 | | 8/2002 | Scaduto | |

FOREIGN PATENT DOCUMENTS

| | | |
|---|---|---|
| EP | 0 841 247 | 4/1997 |
| WO | WO 97/08052 | 3/1997 |

* cited by examiner

*Primary Examiner*—Louis K. Huynh
*Assistant Examiner*—Christopher Harmon
(74) *Attorney, Agent, or Firm*—Richard C. Litman

(57) ABSTRACT

The automatic utensil wrapping machine is an apparatus for wrapping a napkin around one or more utensils for use as a place setting. The apparatus comprises a housing, a support frame and an assembly of elements mounted to the support frame. The assembly of elements includes a napkin lifting station, a napkin wrapping station, a napkin transfer station, a utensil transfer station, and a napkin folding station. The apparatus wraps each napkin around a predetermined amount of utensils without the need for human contact. The napkins are wrapped by first positioning a stack of napkins on the lifting station, then individually transferring napkins from the lifting station to the wrapping station. The utensils are then transferred from the individual cartridges and placed onto the napkin. Two opposing corners of the napkin are then folded over and the napkin is subsequently wrapped around the utensils.

13 Claims, 18 Drawing Sheets

AUTOMATIC UTENSIL WRAPPING MACHINE

BACKGROUND OF THE INVENTION

1. Field of the Invention

The present invention relates to equipment for the food service industry and more particularly to an automated device for wrapping utensils in a napkin for use as a place setting.

2. Description of the Related Art

Restaurants and other food service establishments often roll utensils such as forks, knives and spoons in napkins before presenting them to their customers. Rolling the utensils in this manner serves several purposes, including enhancing the decor of the table and providing a convenient way to prepare a table prior to the customers' arrival. In addition, rolling the utensils in the napkin provides an easy way for the servers to handle the utensils without contacting them and thereby ensuring that the utensils remain clean. Currently, a napkin must be rolled around the utensils one at a time by hand by a waiter, waitress or bus person. This process is time consuming and inefficient. There is currently a need to provide a method and apparatus for increasing the efficiency of this process. A number of automatic utensil packaging devices have been developed in the past in an attempt to reduce the cost associated with wrapping utensils in napkins. Examples of these devices are disclosed in the following patent documents.

U.S. Pat. No. 3,659,394 issued to Hartleib et al. discloses a method and machines for wrapping articles. The method and machine involve withdrawing a sheet of material from a supply reel and leading it into engagement with an article that is to be wrapped. The article is then rotated so that the sheet material is wrapped around the article. The method and machine are used for wrapping and labeling general articles.

U.S. Pat. No. 5,469,688 and International Application number WO 97/08052 issued to Dunbar et al. disclose a method for wrapping silverware in a napkin. The method and apparatus for automatically wrapping at least one eating utensil in a napkin includes a receiving area for the utensils and napkin and a wrapping mechanism. The wrapping mechanism includes a frame, a belt and a belt manipulator. The belt has a first surface that frictionally contacts the napkin. A portion of the belt is movable to form a trough in which the napkin and utensil are manipulated and urged by frictional contact with the belt. The belt urges the napkin and folds and rolls it, automatically wrapping the utensils.

U.S. Pat. No. 6,023,908 issued to Vetsch, K. R. discloses a method and apparatus for folding a napkin around an eating utensil. The device comprises a housing having a conveyor belt system for advancing the napkin through the device along a horizontal path. As the napkin passes through the device it contacts a folding belt that causes a corner of the napkin to be folded back onto it. Pieces of silverware are delivered from storage bins in timed relation to the movement of the napkin and are placed on top of the napkin. The napkins and silverware then contact a rolling belt that rolls the napkin around the silverware. The rolled napkin is transported out of the device and into an external holding bin.

U.S. Pat. No. 6,023,913 issued to Gray et al. discloses an apparatus and method for wrapping silverware within a napkin. The apparatus includes a worktable with an upwardly opening trough for accepting a napkin and silverware items. The napkin is automatically placed over the trough and silverware is then directed onto the napkin so that the silverware falls to the bottom of the trough and positions the napkin between the silverware and the bottom of the trough. A rotatable blade is positioned within the trough for spinning the napkin and silverware until the napkin is wrapped around the silverware.

U.S. patent application Ser. No. 2002/0112445 discloses a device for automatically wrapping eating utensils in a napkin. The device includes a number of hoppers for sortingly holding eating utensils, a tray for holding the napkins, a staging assembly for receiving the napkins from the tray and the utensils from the hopper, a wrapping assembly for wrapping the napkin around the utensils and a banding assembly for placing a band around the wrapped napkin. The device further includes an ultraviolet light assembly for sanitizing the utensils while they are in the hoppers.

U.S. patent application Ser. No. 2002/0124534 discloses an apparatus and method for automatically wrapping silverware in a napkin. The utensil wrapping apparatus includes a utensil-manipulating device for placing the utensils adjacent a napkin. Two utensil engaging devices are provided for releasably engaging the ends of the utensils and the portions of the napkins that are adjacent the utensils. The napkin and utensils are held in a fixed relative position. A napkin guide is provided for wrapping the napkin around the utensils.

European Patent EP 0841247 discloses a device for packing cutlery in a serviette. The serviette is supplied to a conveyor belt that is not as wide as the serviette. At a loading station the cutlery is loaded onto the serviette. In the packing station of the device, two coaxial winding rollers are set spaced by the length of the cutlery at the sides of the belt. The looping angle of the rollers can be increased by a guide roller, placed on the belt underside, so that the paper can roll around the winding rollers to enclose the silverware. The rollers are then raised so the belt stretches. Once the rollers are removed from the winding body, the paper lies on the belt and is moved to the side closing devices to close the ends of the wrapped body.

None of the above inventions and patents, taken either singly or in combination, is seen to describe the instant invention as claimed. Thus an automatic silverware wrapping machine solving the aforementioned problems is desired.

SUMMARY OF THE INVENTION

The automatic utensil wrapping machine is an apparatus for wrapping a napkin around one or more pieces of utensils for use a place setting. The apparatus comprises a housing, a support frame and an assembly of elements mounted to the support frame. The assembly of elements includes a napkin lifting station, a napkin wrapping station, a napkin transfer station, a utensil transfer station, and a napkin folding station. The apparatus wraps each napkin around a predetermined amount of utensils without the need for human contact.

The housing has a generally rectangular, hollow structure having an output opening, a utensil access and a napkin access disposed on the structure. The output opening is an open port in the side of the housing that allows the wrapped napkins to pass out of the apparatus. The utensil access comprises a door that provides access to the interior of the apparatus for loading the apparatus with utensils. The napkin access comprises a door that provides access to the interior of the apparatus for loading the apparatus with napkins. The support frame is positioned inside of the housing and comprises an assembly of vertically oriented beams and horizontally oriented support rails.

The napkin lifting station receives and supports a stack of napkins. The napkins are placed onto the lifting station through the napkin access door. The napkin lifting station includes a platform with a flat top, a plurality of platform supports and a platform lift for incrementally lifting the platform after a predetermined number of napkins are removed from the platform. The stack of napkins is supported by the platform. As napkins are removed from the top of the stack and the height of the stack is thus decreased, the platform lift raises the platform to accommodate the decreased stack height. The apparatus is further equipped with a napkin stack sensor that alerts the user of the apparatus once the entire stack of napkins has been removed from the lifting station platform.

The napkin wrapping station has a plurality of conveyor belts for wrapping a napkin around a predetermined amount of utensils. The napkin wrapping station has a pair of sidewalls, a horizontally oriented, elongated output conveyor belt disposed between the pair of sidewalls, a pair of counter-rotating napkin wrapping belts, a wrapping carriage having a plurality of winding rollers, a wrapping carriage shifter assembly and a plurality of actuators for powering the wrapping station. The combination of wrapping belts and winding rollers wrap each napkin around the predetermined amount of utensils.

The napkin transfer station individually transfers napkins from the lifting station to the wrapping station. The napkin transfer station comprises a base plate with a flat bottom and area that is generally equivalent to the size of the napkins. A plurality of suction devices are disposed along the bottom surface of the base plate. The suction devices are adapted for releasably engaging the napkins. The napkin transfer station also includes a pair of guide rails and a shifter assembly for repositioning the base plate along the guide rails. Once the suction devices engage an individual napkin the shifter transfer station raises the napkin and the shifter assembly moves the base plate along the guide rails until the base plate reaches the wrapping station. At this point the suction devices release the napkin onto the wrapping station.

The utensil transfer station simultaneously places a plurality of different types of utensils onto each individual napkin while the napkin is positioned on the napkin wrapping station. The utensil transfer station comprises a plurality of cartridges for sortingly storing stacks of utensils. Each cartridge contains a different type of utensil and the number of cartridges may vary depending on the amount of different utensils used. The utensil transfer station further comprises a plurality of lifters for lifting each of the stacks of utensils. The lifters force the stacks of utensils upwards so one at a time the utensils may be removed from its cartridge. Once the utensil is forced out of the top of the cartridge a plurality of utensil grippers simultaneously remove a utensil from each stack of utensils. The utensil grippers comprise pneumatic grippers having a pair of fingers that releasably engage the sides of each utensil. The utensil transfer station also includes a shifter assembly for transporting the utensils away from the cartridges, a feed conveyor for receiving the utensils and transferring them to the napkins on the wrapping station and a bracket for mounting the utensil transfer station to the support frame.

Finally, the napkin folding station folds over two opposing corners of the napkin prior to it being wrapped by the wrapping station. Once the utensils are placed onto the napkin the folding station folds over two corners of the napkin to cover the utensils. The folding station comprises a folding arm, a vacuum lift and a shifter assembly. The folding arm has at least one suction device disposed on its bottom surface for releasably engaging the corners of the napkins. The vacuum lift acts to raise and lower the folding arm into contact with the napkin. The shifter assembly allows the folding arm to manipulate the corners of the napkin once they are engaged by the suction device.

According to another aspect of the present there is a method for wrapping a napkin around one or more pieces of utensils. The method includes the steps of first positioning a stack of napkins on the napkin lifting station, then individually transferring napkins from the lifting station to the napkin wrapping station. The different utensils are then transferred from their individual cartridges and placed on the napkin. Two opposing corners of the napkin are then folded over itself and the napkin is subsequently wrapped around the utensils.

The napkin transfer step includes releasably engaging the napkins individually with the napkin transfer plate and then lifting and carrying each napkin to the wrapping station. Each individual utensil is removed from its cartridge by the utensil grippers and transferred to the utensil feed conveyor. The feed conveyor then transports the utensils to the wrapping station and drops the utensils onto the napkin. Two corners of the napkin are then folded over towards the center of the napkin by the folding arm. Finally, the counter-rotating wrapping belts feed the napkin onto a pair of winding rollers that wrap the napkin around the utensils. Once the napkin is wrapped the winding rollers are lowered to allow the wrapped napkin to drop onto the exit conveyor belt and exit out of the apparatus.

Accordingly, it is a principal object of the invention to provide an apparatus and method for wrapping a napkin around eating utensils for use in the food services industry.

It is another object of the invention to provide an apparatus and method for wrapping a napkin around utensils that does not require human handling of the utensils.

It is a further object of the invention to provide an apparatus and method of wrapping a napkin around utensils that is fully automated.

Still another object of the invention is to provide an apparatus and method of wrapping a napkin around utensils that improves restaurant efficiency by allowing food servers to concentrate on other tasks while the apparatus automatically wraps all of the utensils in napkins.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
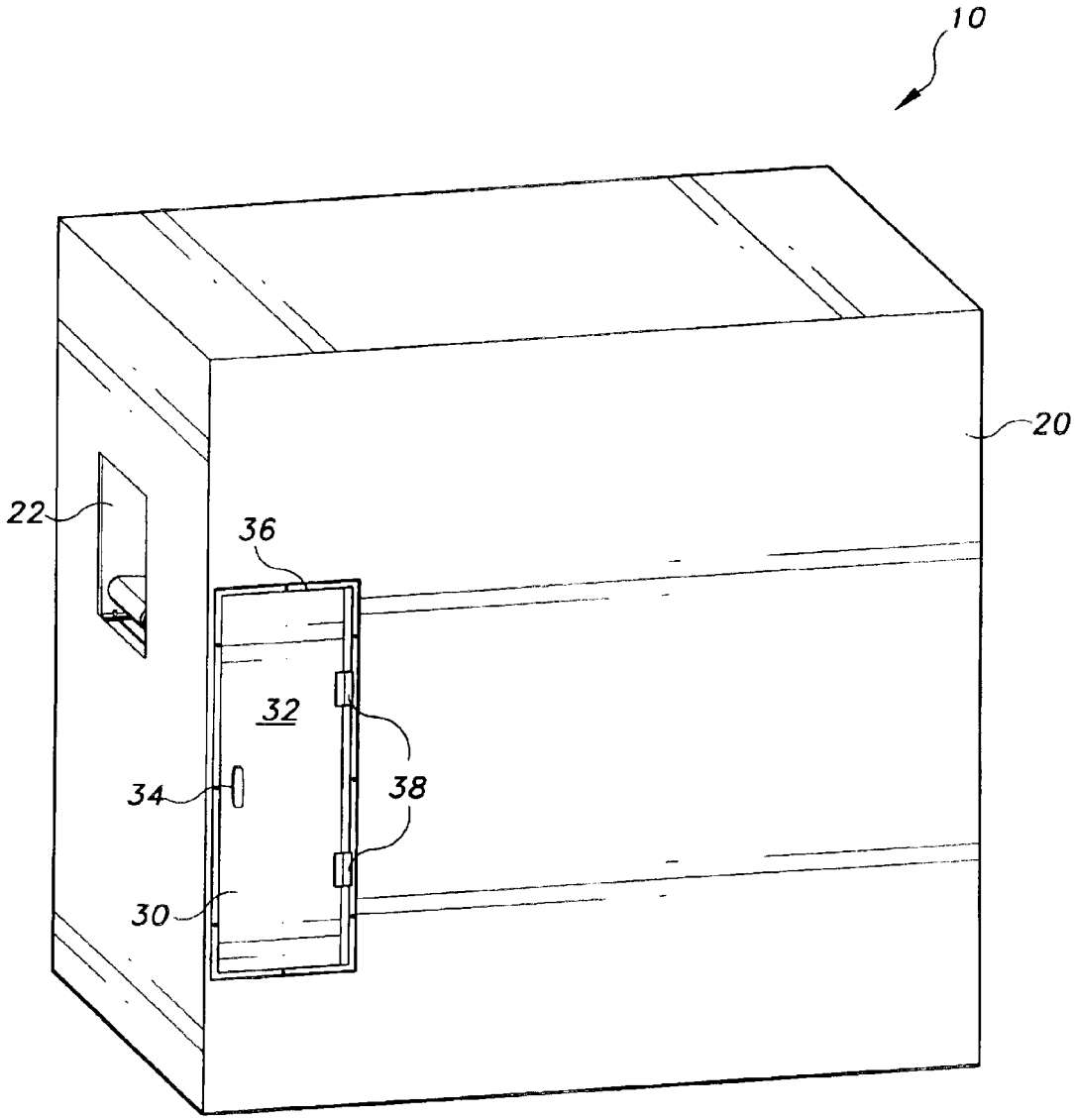
FIG. 1 is an environmental, perspective view of an automatic utensil wrapping machine according to the present invention.
Figure 2:
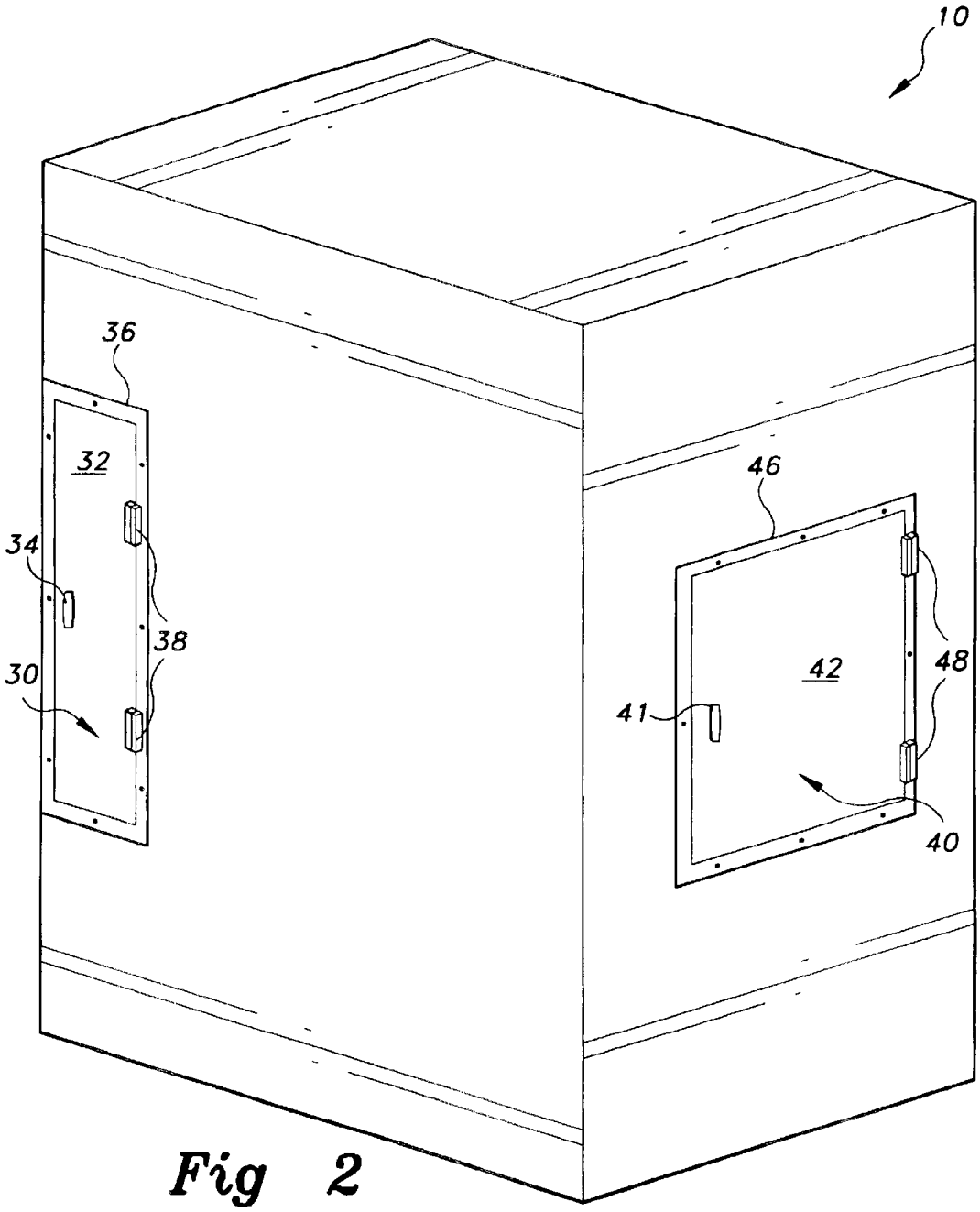
FIG. 2 is a right side perspective view of the utensil wrapping machine.

The present invention is an apparatus for wrapping a napkin around one or more utensils for use as a place setting. The apparatus will be commonly used in the food service industry for automating the process of preparing utensil table settings by providing an apparatus and method of wrapping the utensils without the need for human involvement. The apparatus generally comprises an exterior housing, an interior framework and an assembly of parts disposed on the framework for receiving and wrapping the napkins around one or more utensils. FIGS. 1 and 2 depict environmental, perspective views of the automatic utensil wrapping machine 10. The exterior of the wrapping machine 10 comprise a generally rectangular, hollow housing 20. The housing 20 may be made from any material with suitable durability to protect the interior elements of the wrapping machine 10 that are contained inside of the housing 20. According to the preferred embodiment of the wrapping machine 20, the housing 20 is made from stainless steel.

A plurality of openings are disposed along the housing 20. An output opening 22 is disposed on a first side of the housing 20. The output opening 22 is adapted to allow wrapped utensils to exit the wrapping machine 10 and drop down to a holding area. A utensil access assembly 30 is disposed on the front of the housing 20. The utensil access assembly 30 comprises a door 32, a door frame 36, a plurality of hinges 38 and a handle 34. The door 32 may be opened to gain access to the interior of the wrapping machine 10. The door 32 is adapted to allow utensils to be loaded into the wrapping machine 10. While the wrapping machine 10 is in use the door 32 remains closed to prevent contact with the moving parts inside of the housing 20.

FIG. 2 displays an additional opening, the napkin access assembly 40. The napkin access assembly 40 comprises a door 42, a door frame 46, a plurality of hinges 48 and a handle 44. Similar to the utensil access assembly 30, the door 42 may be opened to gain access to the interior of the wrapping machine 10. The door 42 is adapted to allow napkins to be loaded into the wrapping machine 10. While the wrapping machine 10 is in use the door 42 remains closed to prevent contact with the moving parts inside of the housing 20.

Figure 3:
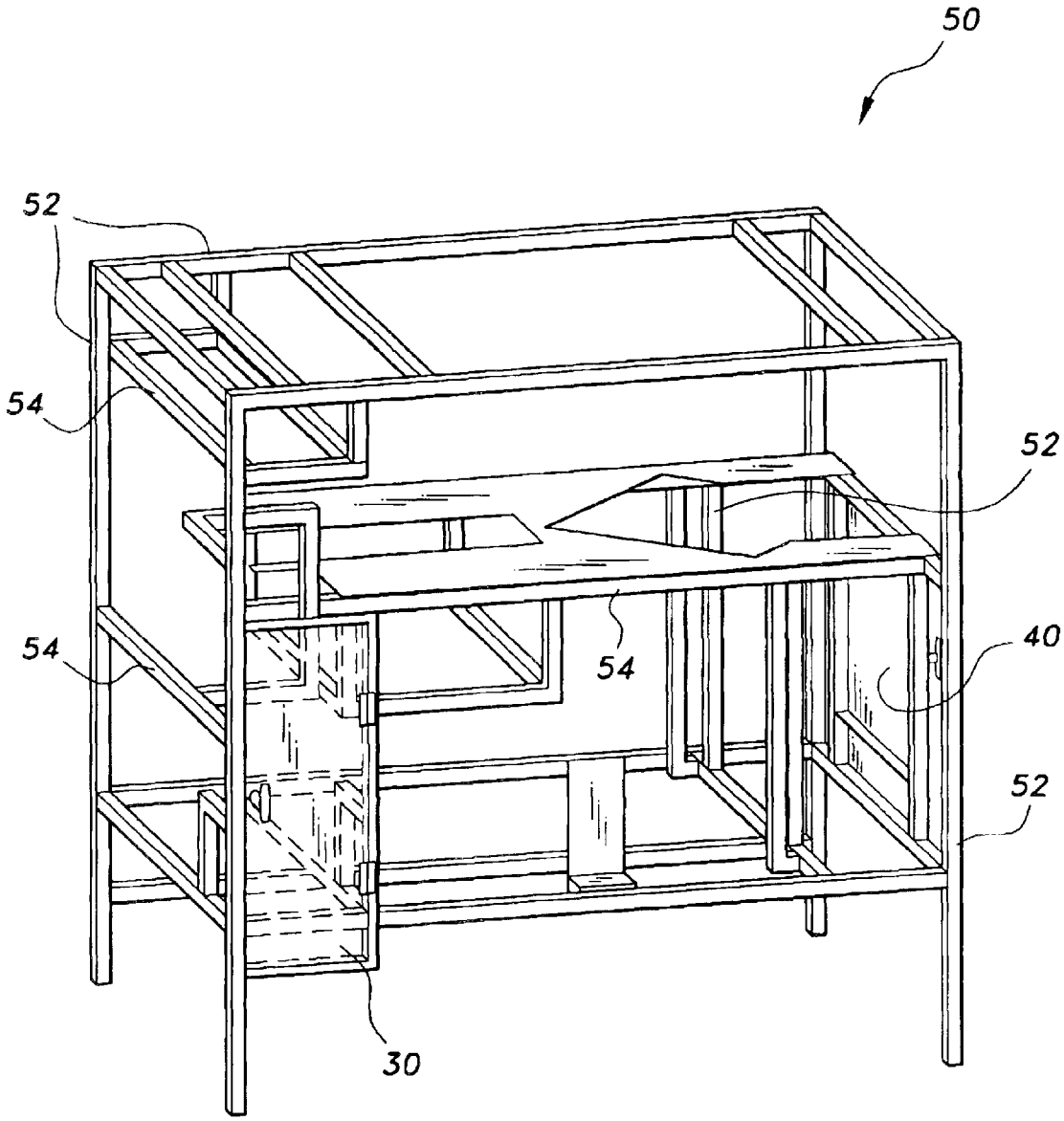
FIG. 3 is a perspective view of the interior framework of the utensil wrapping machine.

FIG. 3 depicts a perspective view of the interior framework 50 of the wrapping machine 10. The framework 50 is positioned on the interior of the housing 20 and supports the assembly of parts used for wrapping the napkins and utensils. The framework 50 comprises a plurality of interconnected, vertically oriented beams 52 and horizontally oriented support rails 54. The framework 50 may be made from any material that will provide suitable strength to support the assembly of parts of the wrapping machine 10. According to the preferred embodiment of the present wrapping machine 10, the framework 50 is made from steel structural tubing.

Figure 4:
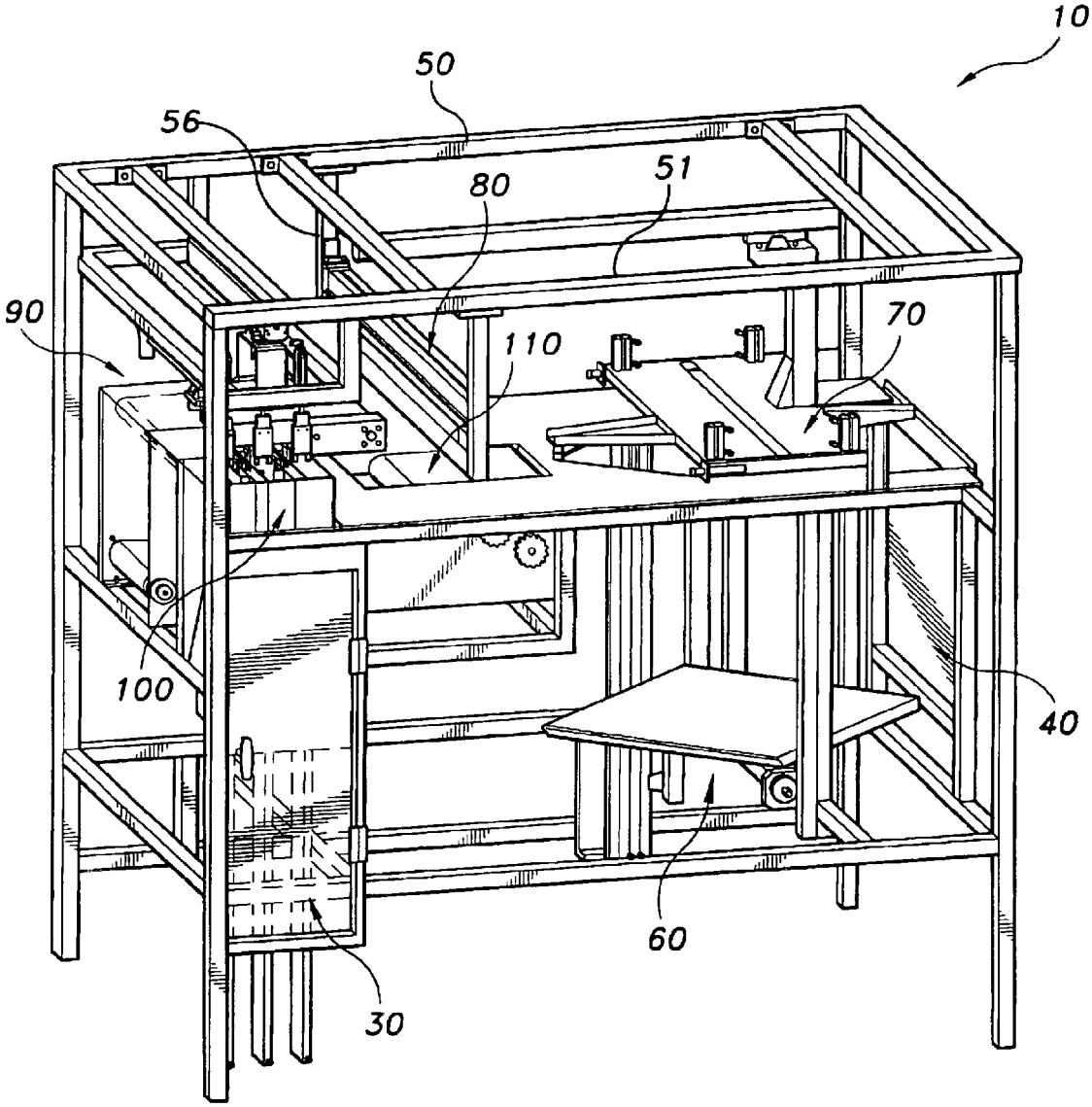
FIG. 4 is a perspective view of the interior assembly of the utensil wrapping machine.
Figure 5:
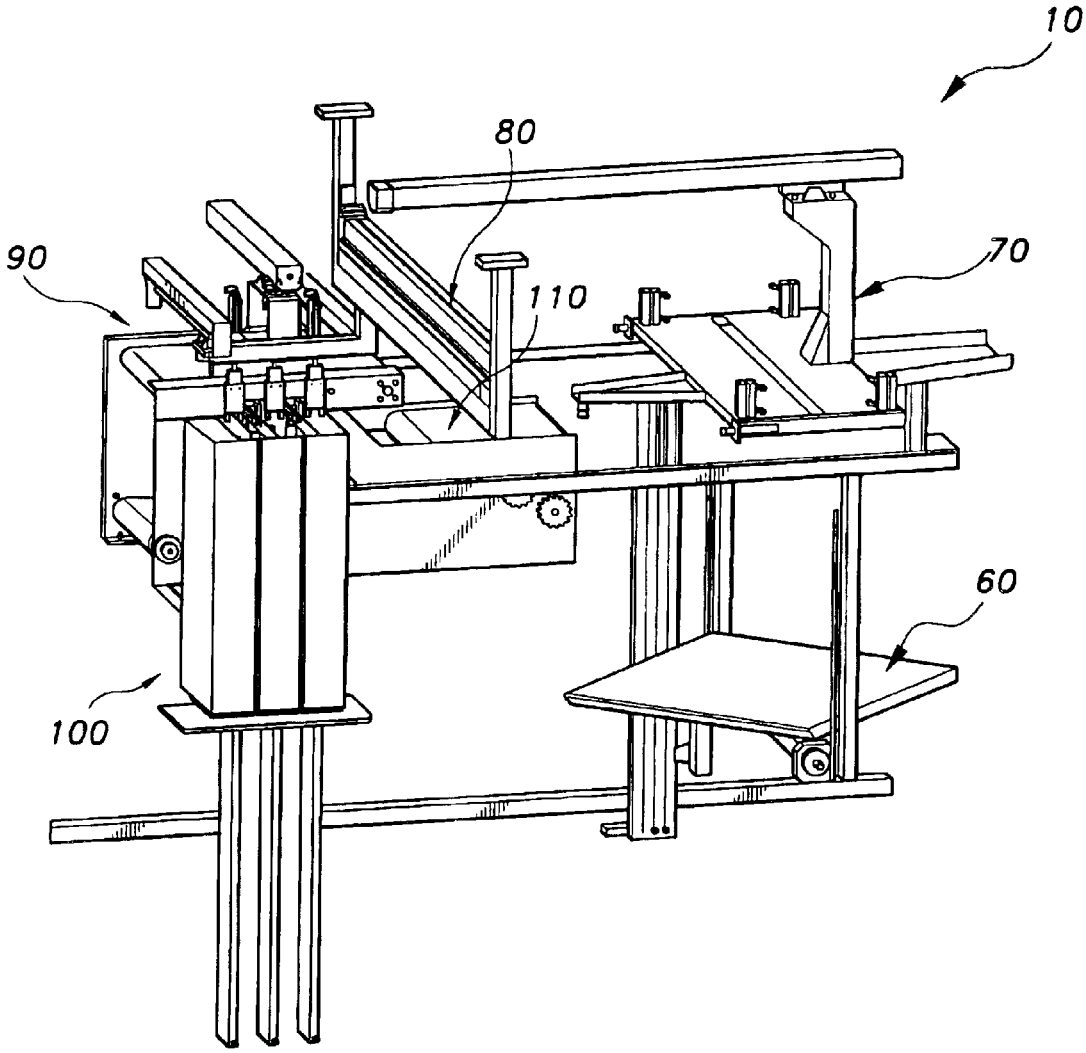
FIG. 5 is a front perspective view of the assembly of elements of the utensil wrapping machine with the framework removed.

FIG. 4 depicts a perspective view of the framework 50 with the assembly of parts of the wrapping machine 10 disposed on the framework 50. The assembly of parts of the wrapping machine 10 work in conjunction with one another in assembly line format to wrap each individual napkin around one or more utensils. The assembly of parts comprises a napkin lifting station 60, a napkin transfer station 70, a napkin folding station 80, a feed conveyor 90, a utensil transfer station 100 and a napkin wrapping station 110. FIG. 5 shows a perspective view of the assembly of parts of the wrapping machine 10 with the framework 50 removed to better depict how each part is interconnected. The napkin lifting station 60 is connected to the napkin transfer station 70, which is then connected to the napkin wrapping station 110. The napkin folding station 80 is secured to the framework 50, directly above the napkin wrapping station 110, by a folding station support 56 (shown in FIG. 4). The feed conveyor 90 is also positioned above the wrapping station 110. Finally, the utensil transfer station 100 is positioned along side of the wrapping station 110.

Figure 8:
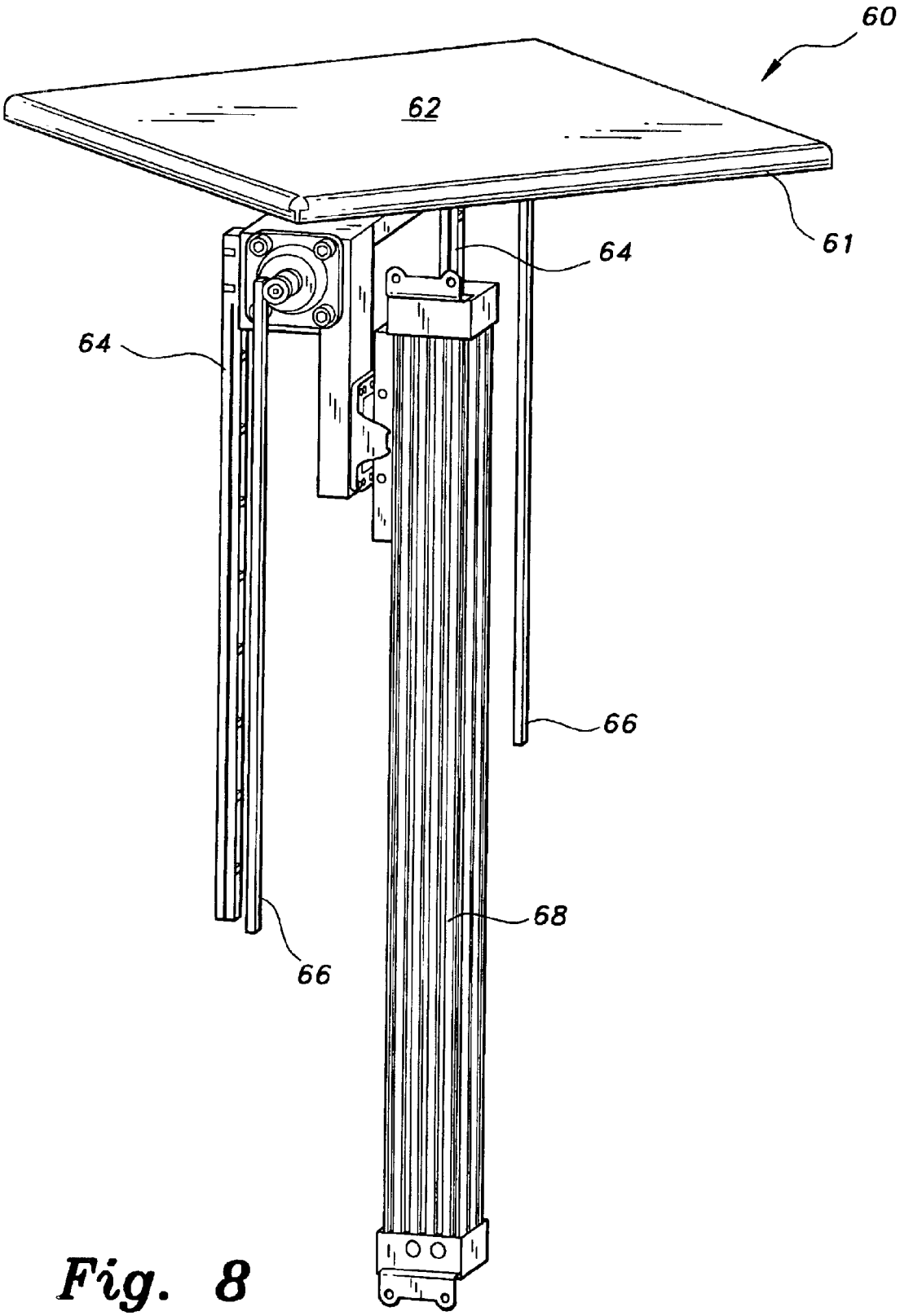
FIG. 8 is a front perspective view of a napkin lifting station.

FIG. 8 depicts a perspective view of the napkin lifting station 60. The napkin lifting station 60 is adapted to receive and support a stack of napkins. Preferably, cloth napkins are used with the wrapping machine 10, but any type of napkin, including but not limited to paper napkins, may also be used with the wrapping machine 10. As shown in FIG. 4, the napkin lifting 60 is aligned with the napkin access assembly 40 so that a stack of napkins may be placed on the napkin lifting station 60 through the napkin door 42. The napkin lifting station 60 comprises a platform 61, having a generally square, flat top 62, a plurality of supports 64, a plurality of gear racks 62 and a shifter assembly 68.

The napkin lifting station 60 is configured according to the size of the napkin being used. The stack of napkins are placed on the top surface 62 of the platform 61. The platform 61 is oriented so that the napkins are turned 45 degrees to the wrapping station 110.

The shifter assembly 68 operates to adjust the height of the stack of napkins by raising or lowering the platform 61. The shifter assembly 68 preferably uses a compressed air cylinder to incrementally lift or lower the platform 61. The compressed air cylinder uses a five-three way control valve to initiate the raising of the platform 61. Once a predetermined number of napkins are removed from the stack, the air cylinder raise the platform 61 to adjust the height of the napkin stack accordingly. This ensures that a napkin will always be available for the wrapping process. The lifting platform may additionally comprise a sensor that will activate a "napkins out" display on the housing 20 of the wrapping machine 10 to signal that the stack of napkins has run out and needs to be replaced. The sensor is preferably an IR sensor, but is not limited in this manner and any suitable sensor may be used.

Figure 17:
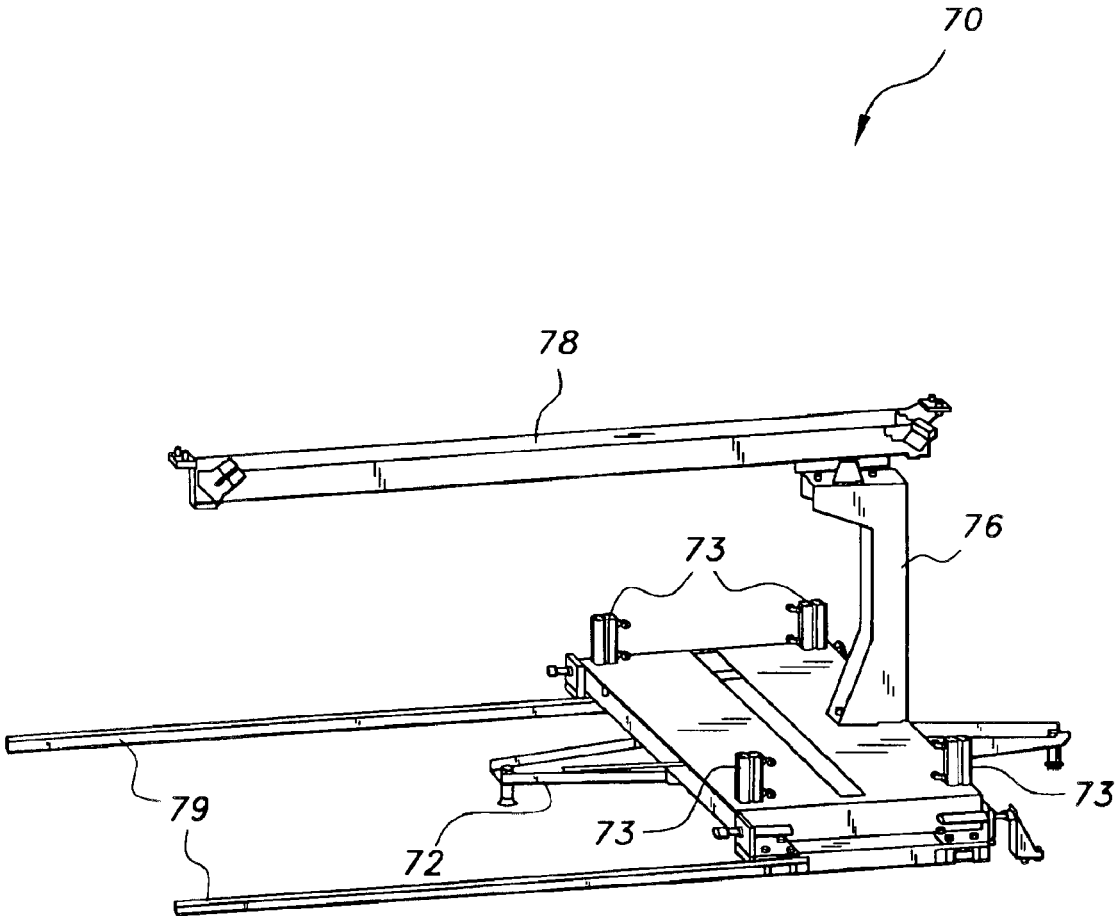
FIG. 17 is a perspective view of the napkin transfer station.

FIG. 17 depicts a perspective view of the napkin transfer station 70. The napkin transfer station 70 transports napkins from the napkin lifting station 60 to the napkin wrapping station 110. The napkin transfer station 70 comprises a base plate 72, an adapter 76, a shifter assembly 78, a pair of guide rails 79 and a plurality of air cylinders 73. The shifter assembly 78 is similar to the shifter assembly on the lifting station 60. The shifter assembly 78 slidably repositions the base plate 72 along the guide rails 79 from the napkin lifting station 60 to the wrapping station 110. The air cylinders 73 are also compressed air cylinders that raise and lower the napkin base plate 72 into contact with the stack of napkins. The adapter 76 is a connector piece that mounts the napkin lifting station 70 to the framework 50.

Figure 7:
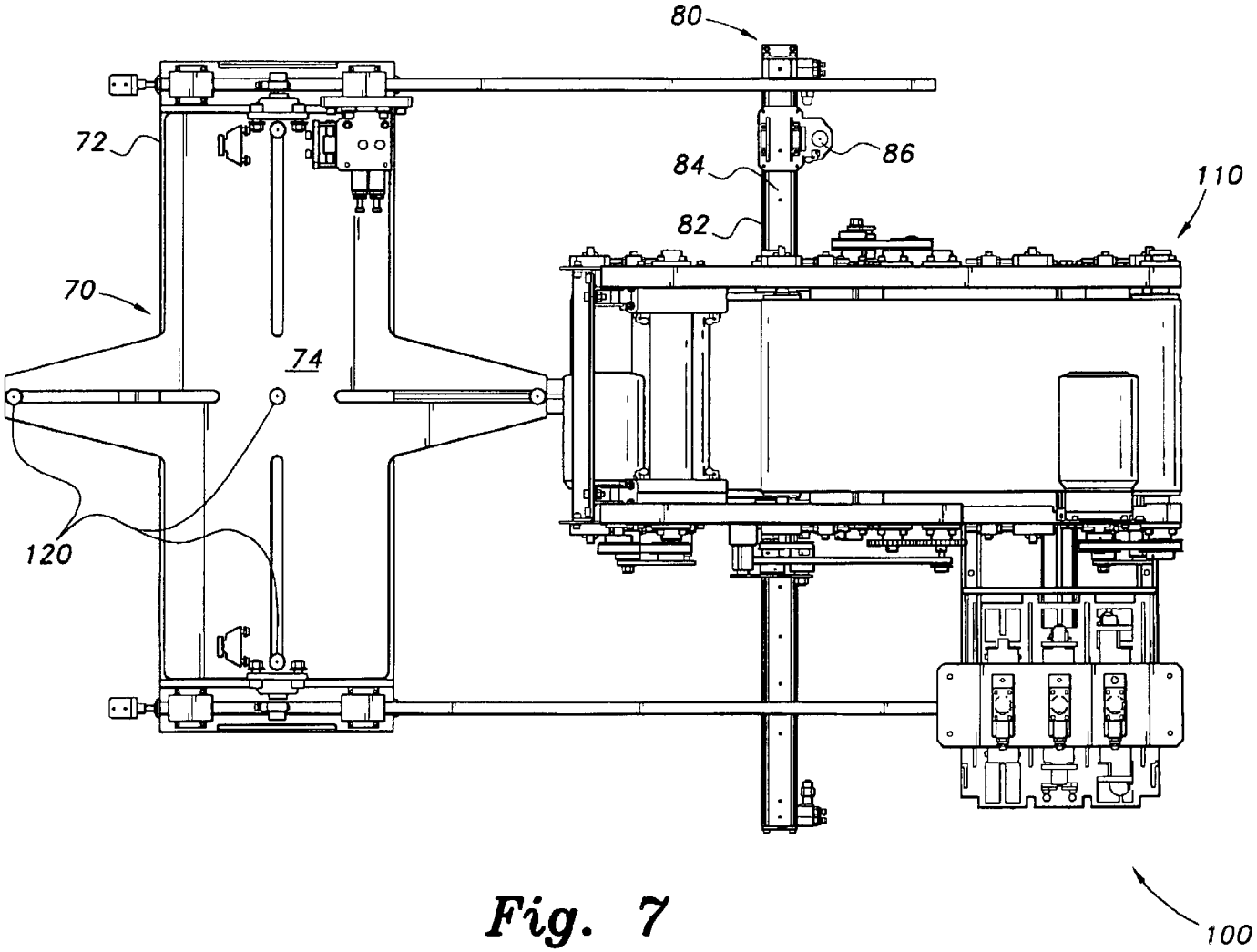
FIG. 7 is a bottom view of the assembly of the utensil wrapping machine.

FIG. 7 depicts a bottom view of the wrapping machine 10. The bottom surface 74 of the base plate 72 is shown. The base plate 72 has a flat bottom 74 with an area that is generally equivalent to the size of the napkins. A plurality of suction devices 120 are disposed along the bottom surface 74 of the base plate 72. The position of the suction devices 120 may be adjusted to fit varying sized napkins. The suction devices 120 are preferably cup shaped and operate by creating vacuum suction to engage the napkin. Once a napkin is delivered by the napkin lifting station 60 the transfer station 70 lowers and the suction devices 120 engage the napkin. Once the napkin is engaged, the transfer station 70 raises the napkin. The shifter assembly 78, which is preferably a compressed air cylinder controlled by limiting sensors, extends to slide the base plate 72 along the guide rails 79. This action delivers the napkin to the wrapping station 110. Once the napkin is transported to the wrapping station 110 the suction devices 120 release the napkin by terminating their vacuum suction and the napkin is placed onto the wrapping station 110.

Figure 9:
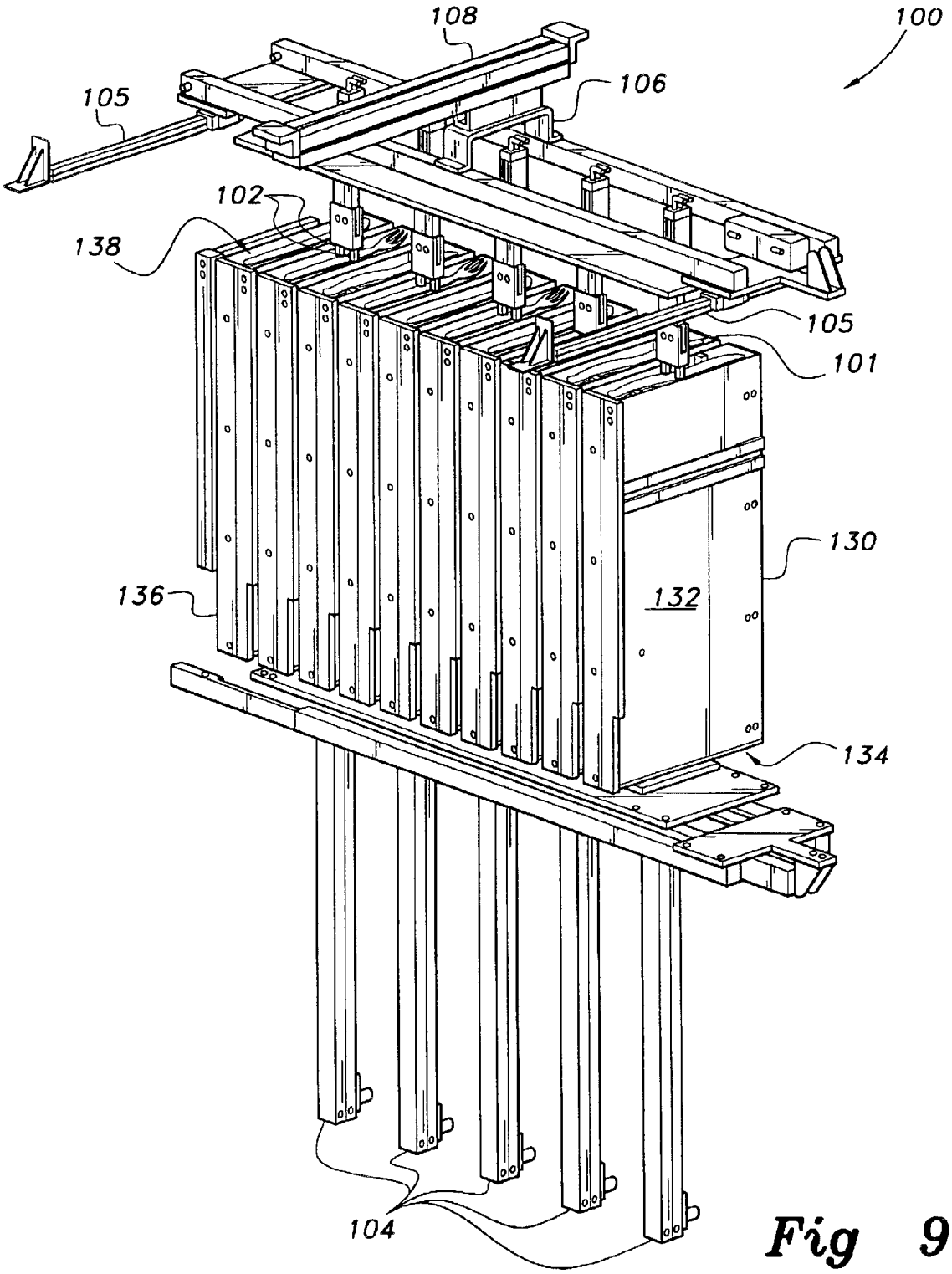
FIG. 9 is a front perspective view of a utensil transfer station.

While the napkin lifting station 60 and the napkin transfer station 70 are active, the utensil transfer station 100 is also operating. FIG. 9 depicts a perspective view of the utensil transfer station 100. The utensil transfer station 100 comprises a plurality of utensil grippers 101, a pair of guide rails 105, a mounting bracket 106, a shifter assembly 108, a plurality of utensil lifters 104 and a plurality of utensil storing cartridges 130. The utensil transfer station 100 operates to deliver the utensils to the feed conveyor 90. As shown in FIG. 4, the utensil transfer station 100 is aligned with the utensil access assembly 30 so that utensils U may added to the transfer station 100 through the access door 32. The cartridges 130 may be removed from the housing 20 and then loaded with utensils U. Once loaded, the cartridges 130 are replaced into the utensil transfer station 100 through the utensil access door 32.

Figure 10:
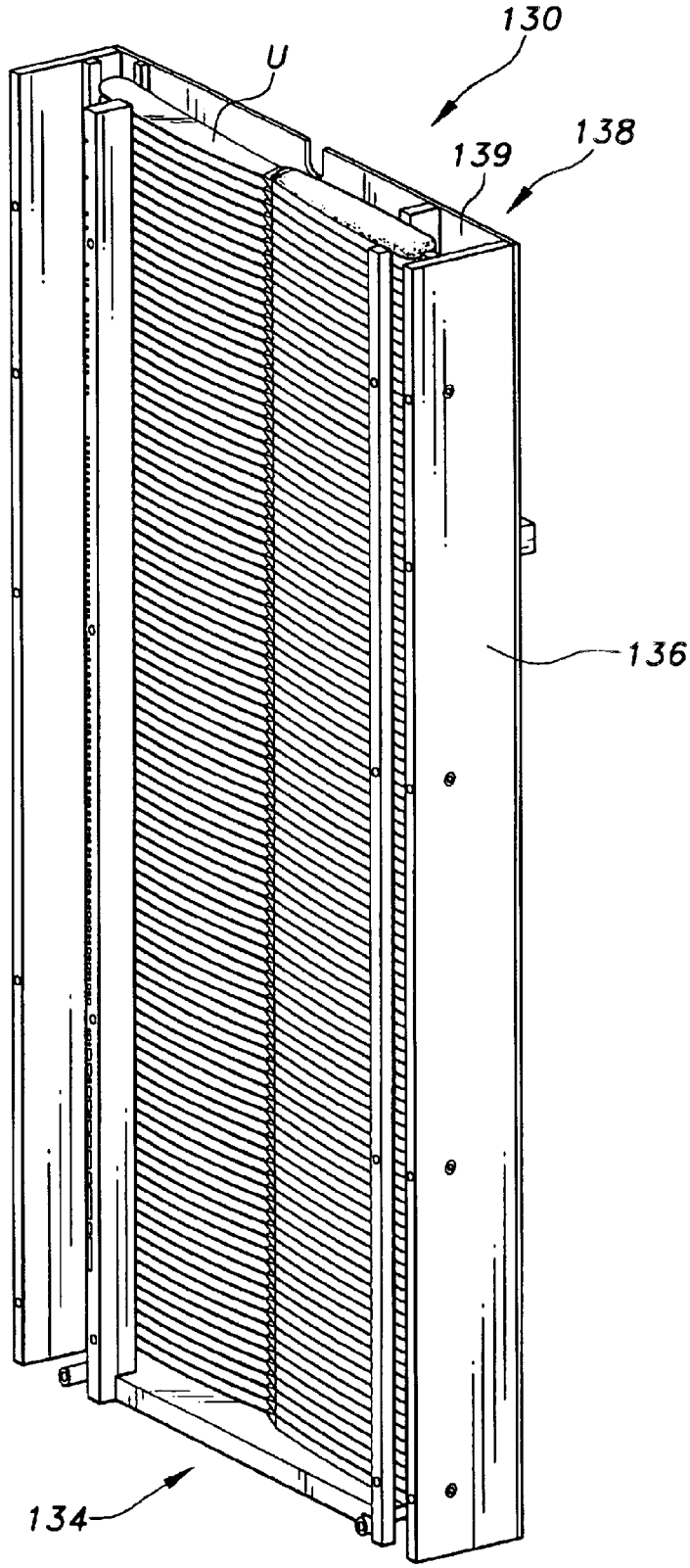
FIG. 10 is a front perspective view of a cartridge for the utensil transfer station with its front wall removed.
Figure 11:
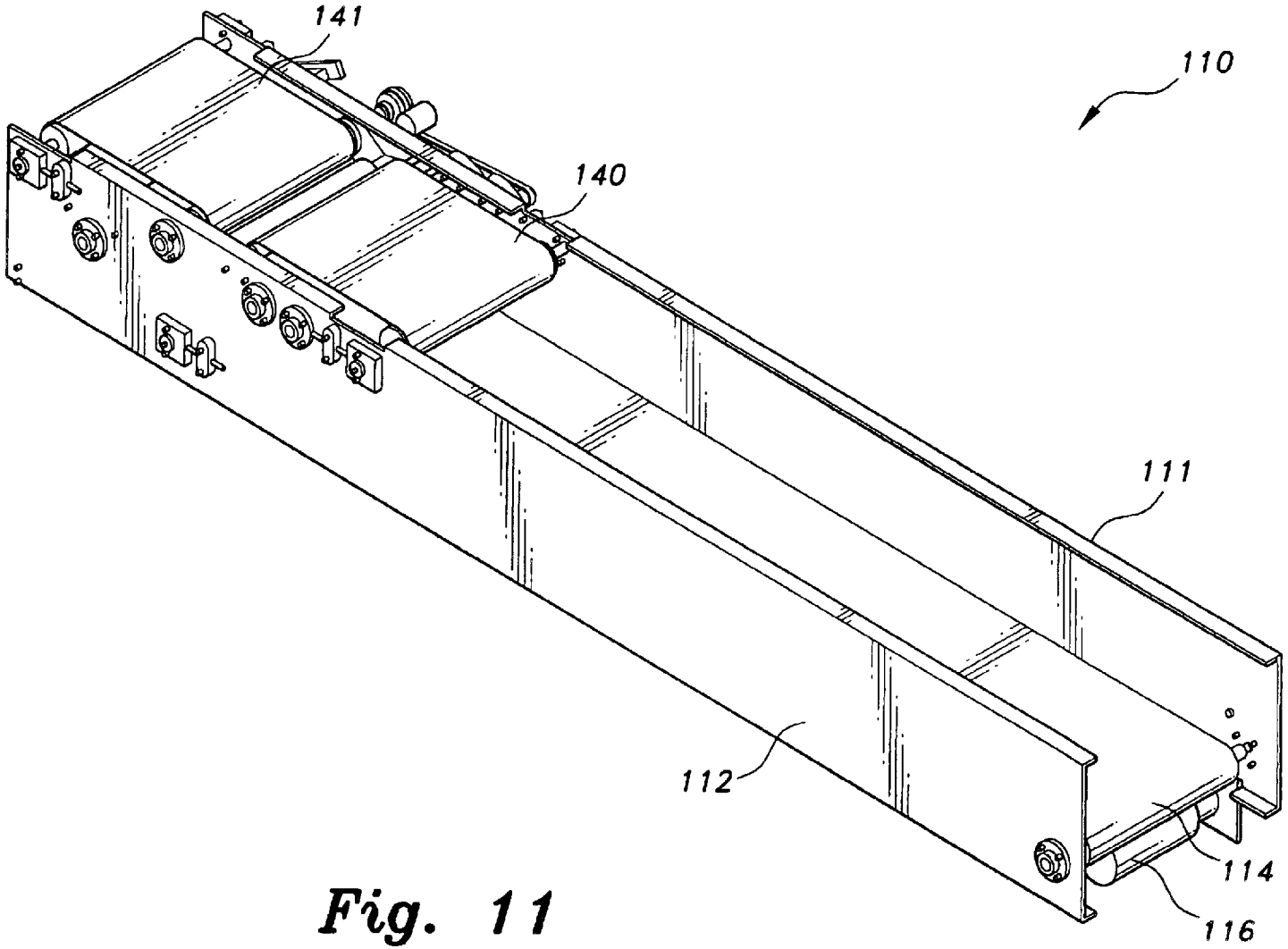
FIG. 11 is a top perspective view of a napkin wrapping station.

The cartridges 130 comprise front and back walls 132, side walls 136, a bottom surface 134 and an open top 138. FIG. 10 depicts a front perspective view of an individual cartridge 130 with its front wall 132 removed to reveal its interior 139. Each cartridge 130 sortingly stores a stack of utensils U. The utensils U are stacked horizontally, one on top of the other. Each cartridge 130 stores an different type of utensil U so the number of cartridges 130 depends on the number of different types of utensils U used in the place setting. In the preferred embodiment of the wrapping machine 10 each cartridge stores 50 utensils U, but the cartridges are not limited to storing this number of utensils U. Any type of utensil, including but not limited to silverware, stainless steel and plastic, may be used with the wrapping machine 10.

The utensil lifters 104 simultaneously lift utensils U, one at a time, out of the top opening 138 of the cartridges 130. The lifters 104 have compressed air cylinders that control the raising of the utensils U. The lifters 104 push the utensils U to the top of the cartridges using a five-three way valve to initiate each incremental rise of the stack of utensils U. The cartridges 130 may also comprise a sensor that activates a "cartridge empty" signal to alert the users of the wrapping machine 10 that the utensils U need to be replaced.

The utensil grippers 101 engage the utensils U when they are pushed out of the top opening 138 of the cartridges 130. The plurality of grippers 101 simultaneously engage one utensil U from each of the cartridges 130. The utensil grippers 101 comprise a pair of pneumatic fingers 102 that engage each of the utensils U by gripping the utensils U on either side and pinching the utensil U to secure it between the pneumatic fingers 102. Once the utensil grippers 101 engage the utensils U the utensil grippers 101 are raised and the shifter assembly 108 simultaneously transports the grippers 101 along the guide rails 105 until they are above the feed conveyor 90. The utensil grippers 101 release the utensils U onto the feed conveyor 90 and the shifter assembly 103 returns the grippers back to their original position.

Figure 18:
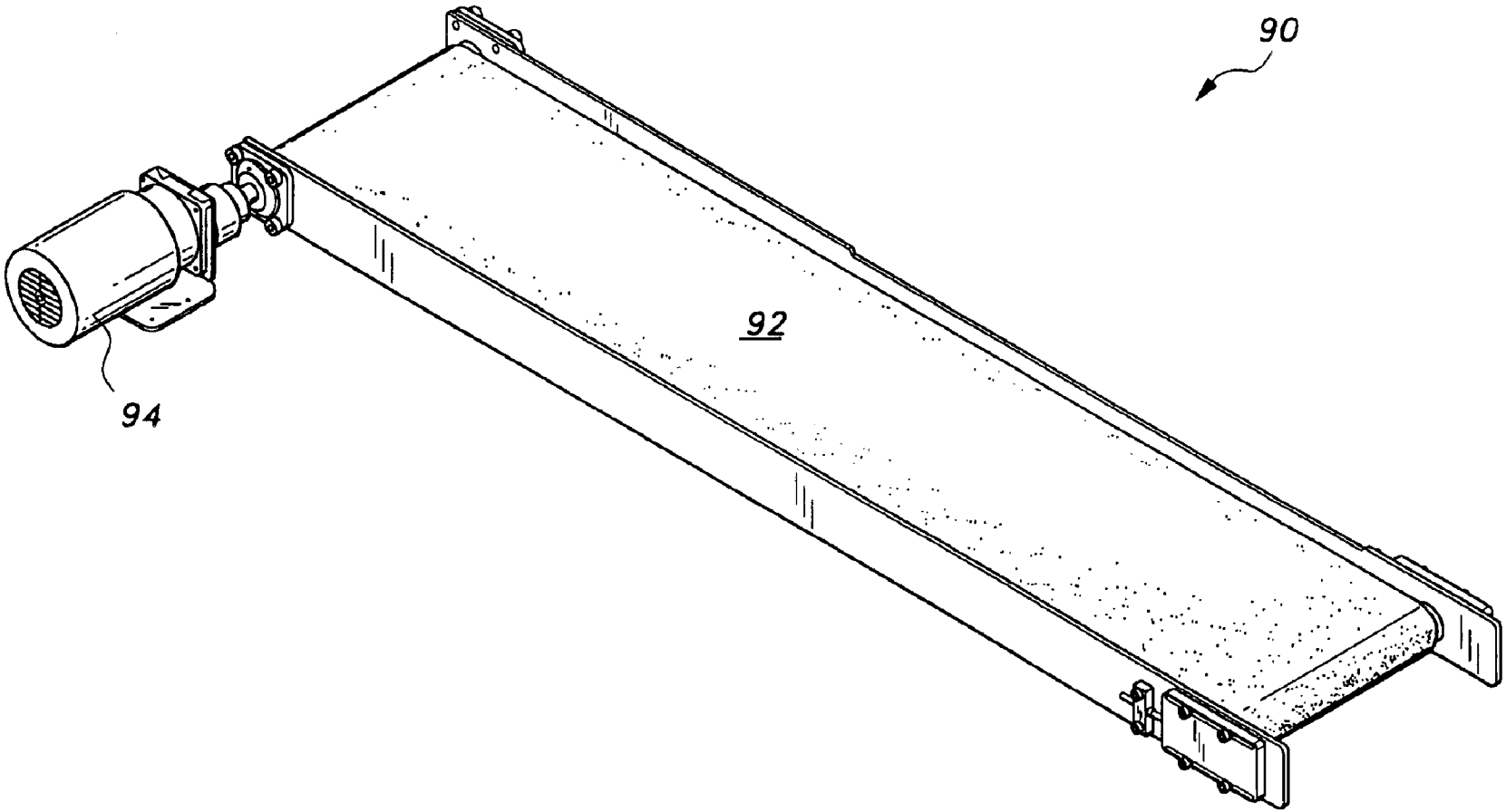
FIG. 18 a top perspective view of a feed conveyor.

FIG. 18 depicts a perspective view of the feed conveyor 90. The feed conveyor 90 comprises a conveyor belt 92 that is driven by a motor 94. The feed conveyor 90 is positioned above the wrapping station 110. The feed conveyor 90 receives the utensils U from the utensil transfer station 100 and then delivers them to the napkin positioned on the wrapping station 110.

Figure 15:
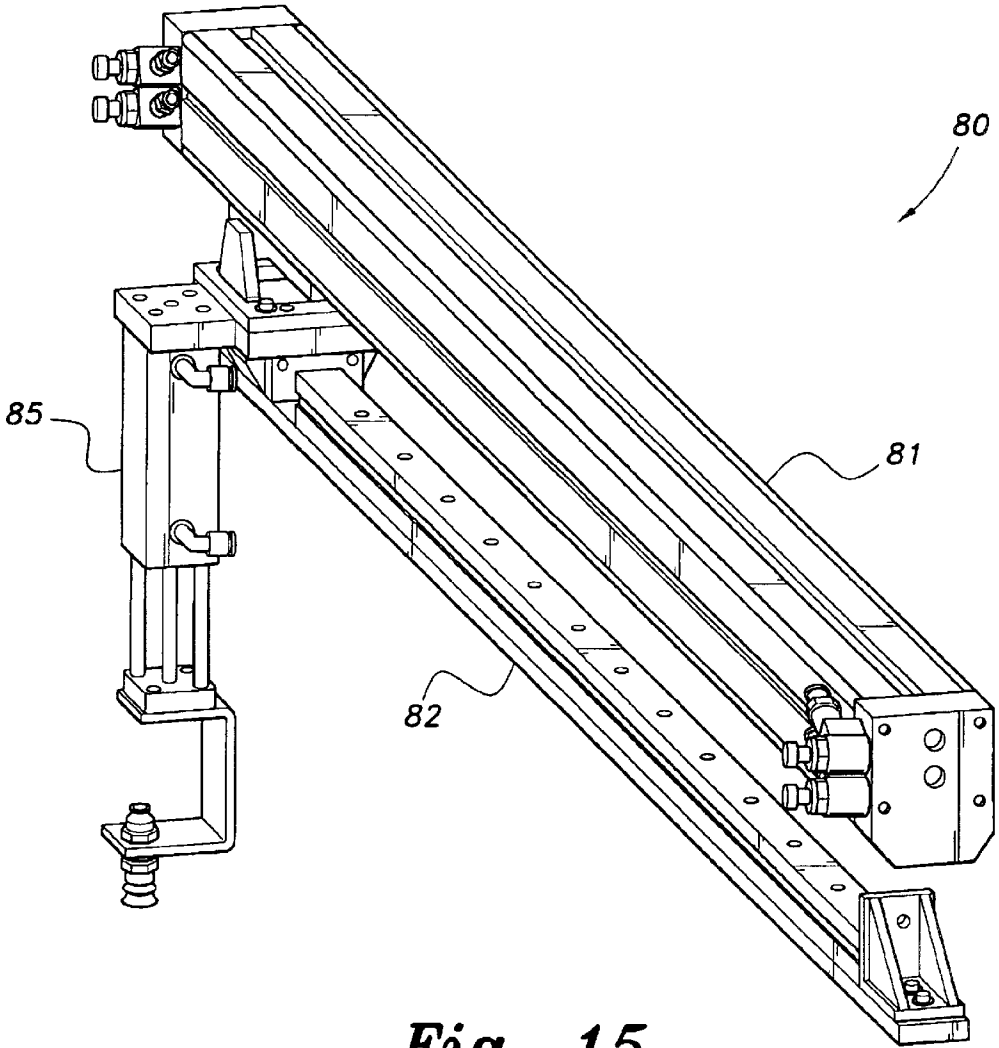
FIG. 15 is a perspective view of the napkin folding station.

FIG. 15 depicts a perspective view of the folding station 80. The folding station 80 operates to fold over two opposing corners on the napkin prior to it being wrapped by the wrapping station 110. The folding station 80 comprises a folding arm 82, a shifter assembly 81, and a vacuum lift 85. Referring to FIG. 7, a suction device 86 is disposed on the bottom surface 84 of the folding arm 82. The suction device 86 is identical to the suction devices 120 found on the napkin transfer station 70.

Figure 16:
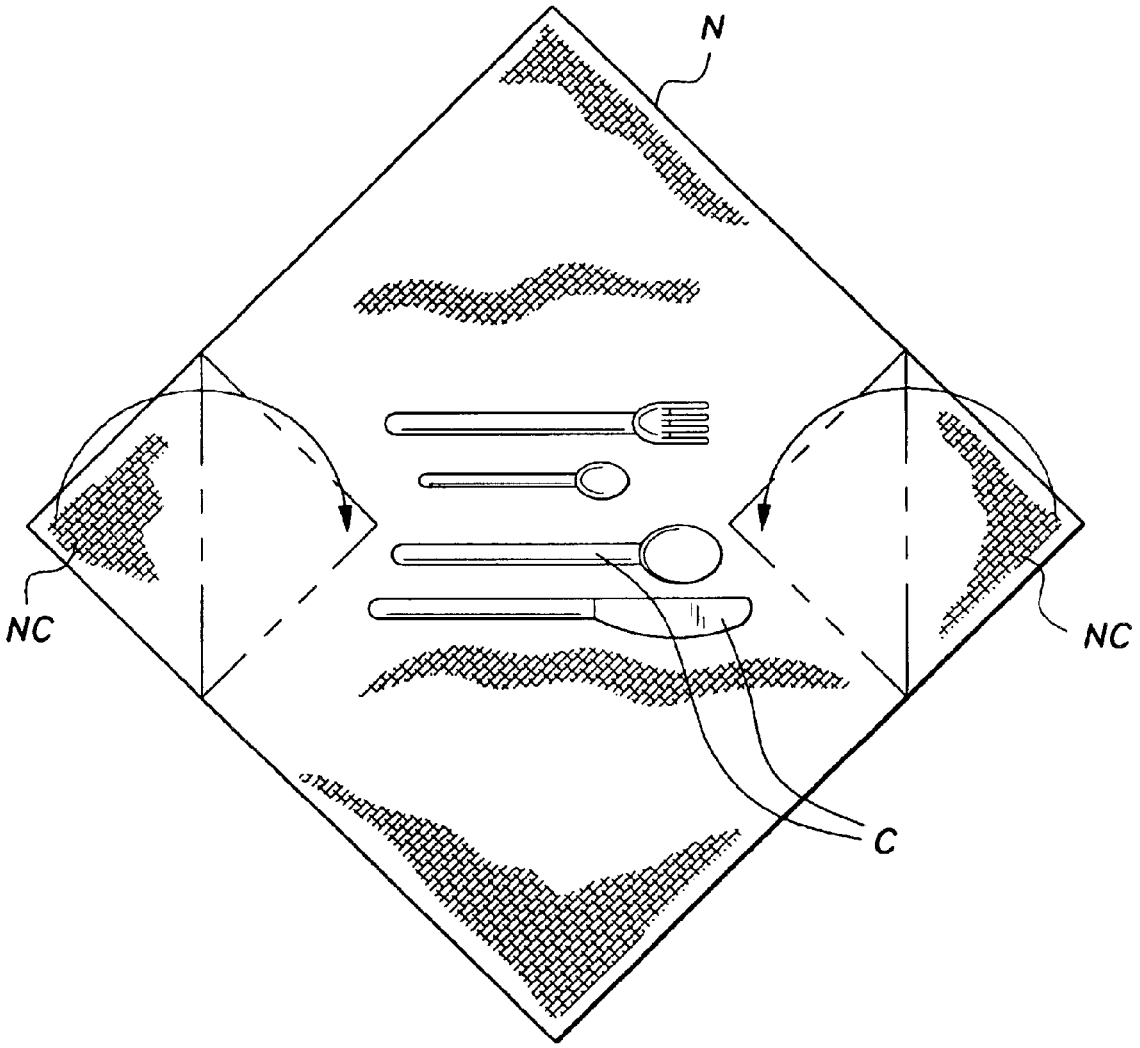
FIG. 16 is a top view of a napkin with utensils disposed thereon.

The shifter assembly 81 and the vacuum lift 85 are both compressed air cylinders that control the movement of the folding arm 82. The vacuum lift 85 raises and lowers the arm 82, while the shifter assembly 81 extends the arm 82. FIG. 16 demonstrates the operation of the folding arm 82. The shifter assembly 81 moves the folding arm 82 to the nearest napkin corner C. The folding arm 82 then lowers until the suction device 86 engages the napkin N. The folding arm 82 extends across the napkin N until it activates a first fold sensor that causes the suction to terminate and the first fold of the napkin N is completed. The folding arm 82 then extends across the napkin N to the second corner C and the arm 82 lowers to engage the napkin N. The folding arm 82 then moves back across the napkin N until it reaches the second fold sensor, which terminates suction and completes the second fold. As shown in FIG. 16 two opposing corners C of the napkin have now been folded over towards the utensils U in the center of the napkin N.

FIGS. 11–14 depict varying views of the napkin wrapping station 110. The napkin wrapping station 110 comprises a front wall 112, a back wall 111, a pair of counter-rotating top wrapping belts 140,141, an exit conveyor 114 and plurality of motors for operating the wrapping station 110. When the napkin N is placed onto the wrapping station each of the unfolded corners of the napkin N rest on one of the two wrapping belts 140,141 with the center of the napkin N and the utensils U resting in the gap between the two belts 140, 141.

Figure 12:
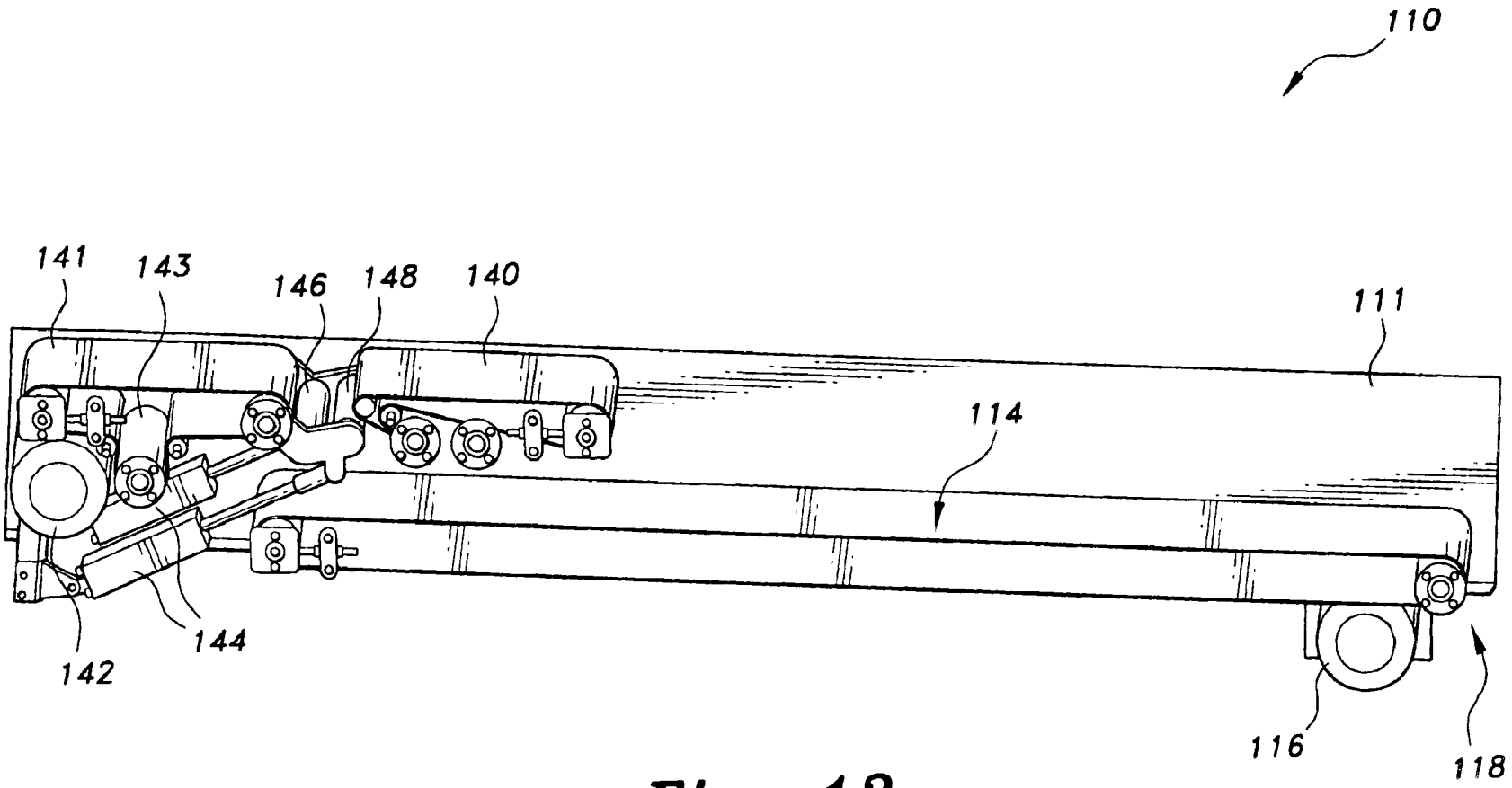
FIG. 12 is a front perspective view of the napkin wrapping station with its front wall removed.
Figure 14:
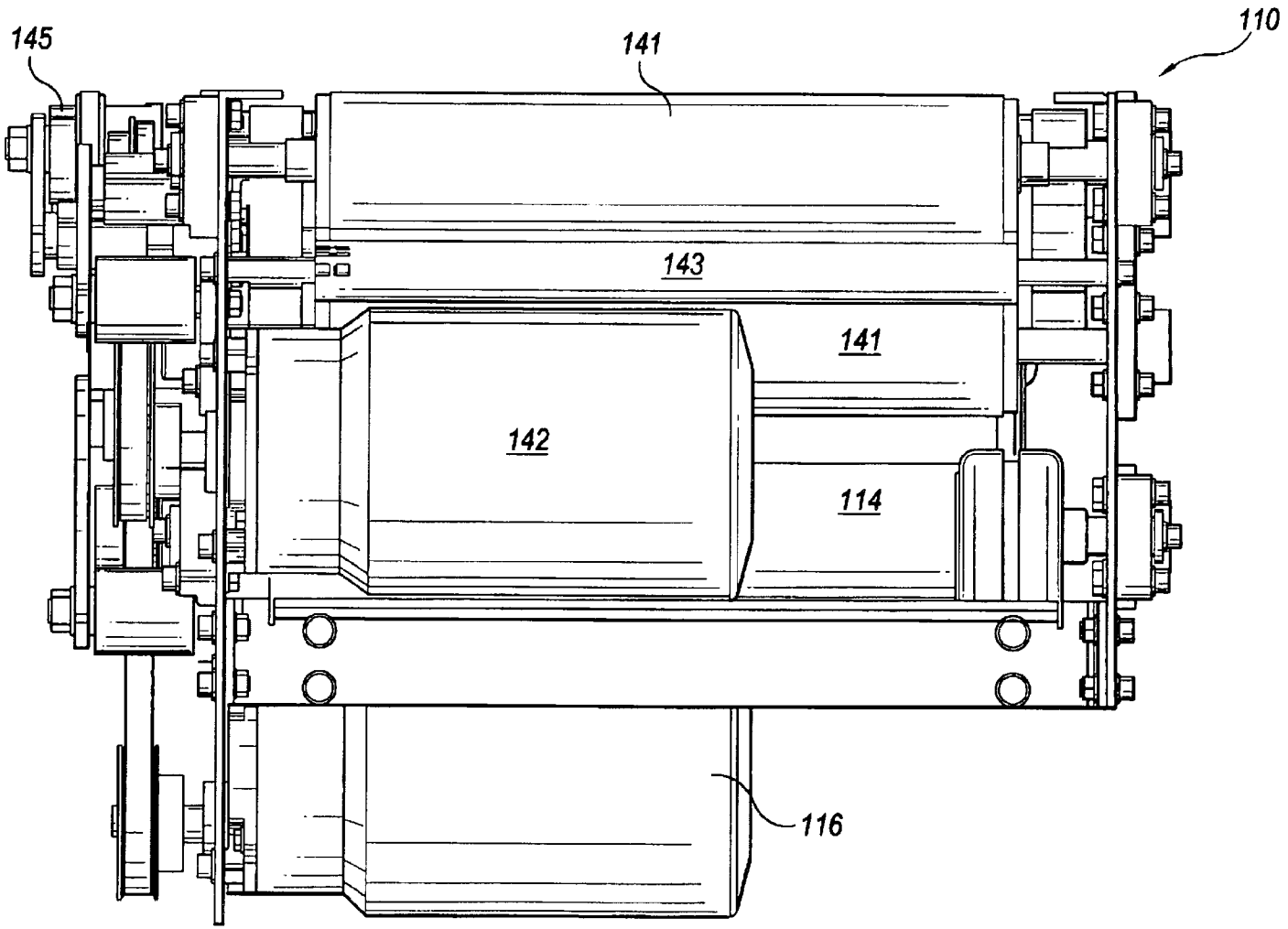
FIG. 14 is a side view of the napkin wrapping station.

FIG. 12 depicts a front perspective view of the wrapping station 110 with the front wall 112 removed to reveal the interior elements of the wrapping station 110. Exit conveyor motor 116 and wrapping belts motor 142 are shown at either end of the wrapping station 110. The wrapping station 110 further comprises a winding carriage having a first winding roller 146 and a second winding roller 148 and a winding carriage shifter 144 positioned underneath the winding rollers 146, 148. FIG. 14 depicts a side view of the wrapping station 110 further depicting the arrangement of the plurality of belts and rollers. FIG. 14 depicts the gears 145 and the belt roller 143 that operate the counter-rotating wrapping belts 140, 141.

Figure 6:
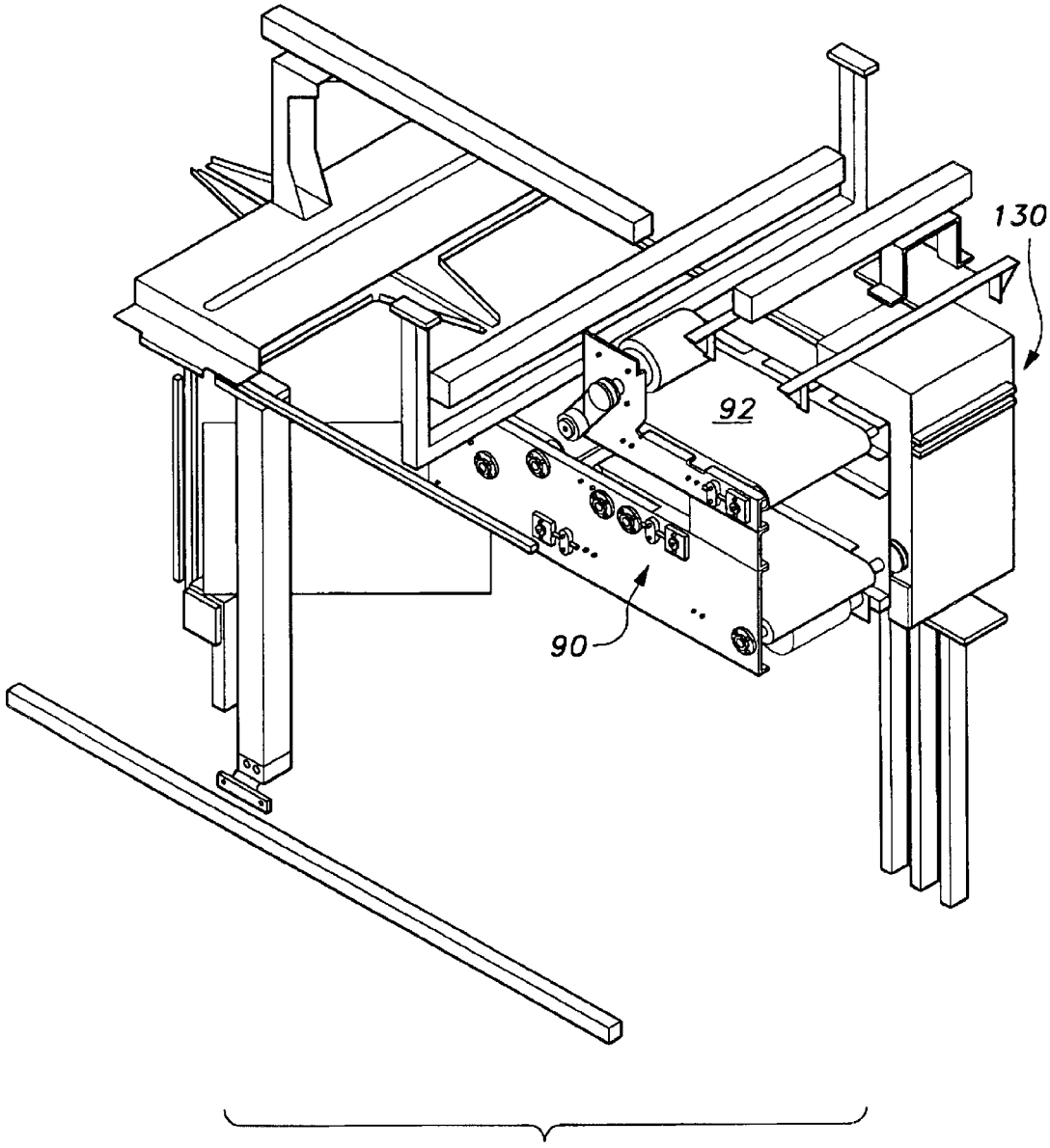
FIG. 6 is a rear perspective view of the assembly of the utensil wrapping machine with the framework removed.

Referring to FIGS. 5 and 6 a method is disclosed for wrapping a napkin N around one or more utensils U. Prior to activating the wrapping machine 10, a stack of napkins N is placed onto the napkin lifting station 60. The napkins N are passed through the napkin access door 42 and onto the platform 61 of the lifting station 60. Also, the cartridges 130 from the utensil transfer station 100 are removed from the housing 20 and filled with the different types of utensils U being used. Once filled the cartridges 130 are place onto the utensil transfer station 100 through the utensil access door 32.

Napkins N are then individually removed from the lifting station 60 by the napkin transfer station 70. The napkin transfer station 70 lowers so that the suction devices 120 disposed along the bottom surface 74 of the base plate 72 can engage the napkins N. The napkin transfer station 70 rises and transports the napkin N to the napkin wrapping station 110. At the napkin wrapping station 110 the transfer station 70 lowers, the suction devices 120 release the napkin N onto the wrapping belts 140,141 of the wrapping station 110, and the transfer station 70 returns to its original position.

While the napkin lifting station 60 and the napkin transfer station 70 are active, the utensil transfer station 100 is transporting utensils U to the feed conveyor (shown in FIG. 6). The lifters 104 push the utensils U out of the top opening 138 of the cartridges 130 where the utensils U are engaged by the utensil grippers 101. The utensil grippers 101 carry the utensils U to the feed conveyor 90 and release them onto the belt 92. The belt 92 then delivers the utensils U to the wrapping station 110 and deposits the utensils U onto the napkin N. The napkin N is then wrapped around the utensils U by the assembly of wrapping belts 140, 141 and winding rollers 146, 148 of the wrapping station 110.

Figure 13:
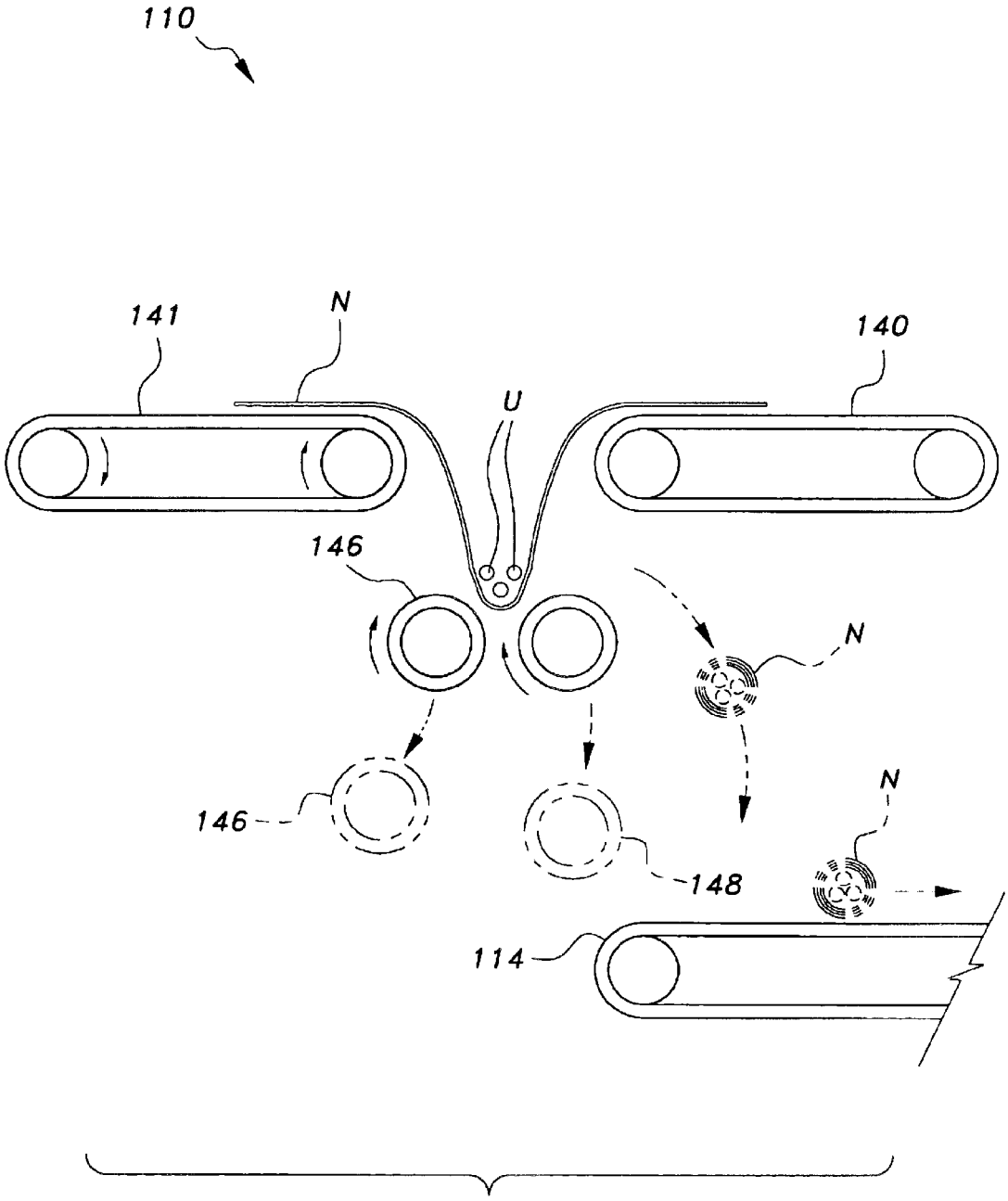
FIG. 13 is a front functional view of the napkin wrapping station.

FIG. 13 is a front schematic view of the wrapping station 110 depicting its functional aspects. The napkin N is positioned across the gap between the two wrapping belts 140, 141. The utensils U are positioned in the center of the napkin N. The counter-rotation of the belts 140,141 feeds the unfolded ends of the napkin N down towards the first and second winding rollers 146, 148, which are both rotating in the same direction. The arrows shown in FIG. 13 depict the direction of rotation of the belts and rollers and the direction in which the napkin N is moving through the wrapping station. As the napkin N is lowered below the wrapping belts 140, 141 the winding rollers 146, 148 roll the napkin N so that is completely wraps itself around the utensils U. Once the napkin N is wrapped around the utensils U the carriage shifter 144 lowers the winding rollers 146,148 so that the napkin N drops down onto the exit conveyor 114. The napkin then travels along the exit conveyor 114 to its output end 118 (shown in FIG. 12) and are delivered out of the housing 20. The second winding roller 148 is then lifted back to its original position.

It is to be understood that the present invention is not limited to the embodiment described above, but encompasses any and all embodiments within the scope of the following claims.

We claim:

1. An apparatus for wrapping a napkin around one or more utensils, comprising:

a generally rectangular hollow housing having, an output opening disposed on said housing, a utensil input and a napkin input;

a support frame, positioned inside of said housing, having an assembly of vertically oriented beams and horizontally oriented support rails;

a napkin lifting station for receiving and supporting a stack of napkins, the napkins being placed onto said lifting station through said napkin input;

a napkin transfer station;

a utensil transfer station for simultaneously placing a plurality of utensils onto an individual napkin while the napkin is positioned on the napkin wrapping station;

said utensil transfer station including a plurality of cartridges for sortingly storing stacks of a plurality of types of utensils, a plurality of utensils grippers for lifting and removing selected utensils from the cartridges, a feed conveyor belt for transporting selected utensils to the napkin, and a bracket for mounting the said utensil transfer station to said support frame;

a napkin folding station for folding over corners of a napkin prior to being wrapped by said wrapping station; and a napkin wrapping station having a plurality of conveyor belts for wrapping a napkin around a predetermined amount of utensils;

wherein said napkin transfer station individually transfers napkins from said napkin lifting station to said napkin wrapping station;

said napkin lifting station, napkin wrapping station, napkin transfer station, napkin folding station and utensil transfer station are each disposed on said support frame;

whereby a predetermined amount of utensils are automatically wrapped in a napkin for use as a place setting without the need of human contact.

2. The apparatus according to claim 1, wherein said napkin lifting station further including:

a platform having a flat top surface;

a plurality of platform supports; and a platform lift for incrementally lifting said platform after a predetermined number of napkins are removed from the napkin lifting station.

3. The apparatus according to claim 2, said napkin input further including a door disposed on said housing and aligned with said napkin lifting station to allow the napkins to be placed on said napkin lifting station.

4. The apparatus according to claim 1, wherein said napkin wrapping station further including:

a pair of sidewalls;

a horizontally oriented, elongated output conveyor belt disposed between the pair of sidewalls;

a pair of counter-rotating napkin wrapping belts;

a wrapping carriage having a plurality of winding rollers;

a wrapping carriage shifter assembly; and a plurality of actuators for powering said napkin wrapping station.

5. The apparatus according to claim 4 wherein said output opening is aligned with said output conveyor belt so that the wrapped utensils will exit out of the apparatus along said output conveyor belt and through said output opening.

6. The apparatus according to claim 1, said napkin transfer station further including:

a base plate having a flat bottom surface and an area generally equivalent to the size of a napkin;

a plurality of suction devices, for releasably engaging the napkins, disposed along the bottom surface of the base plate;

a height adapter for raising and lowering said base plate;

a pair of guide rails; and a shifter assembly for repositioning said base plate along the guide rails.

7. The apparatus according to claim 1, said utensil transfer station further including:

a plurality of lifters for lifting each of the stacks of utensils; and a shifter assembly for lifting and transporting the utensils from the cartridges.

8. The apparatus according to claim 7 wherein said feed conveyor belt receives the utensils from the utensil grippers and subsequently transports the utensils to the napkins, and said shifter assembly moves said utensil grippers between said plurality of cartridges and said feed conveyor belt.

9. The apparatus according to claim 7 wherein each of said cartridges contains a different type of utensil and the number of cartridges used may vary depending on the number of different utensils used.

10. The apparatus according to claim 7, said utensil grippers further including a pneumatic gripper having a pair of fingers for releasably engaging the sides of the utensils.

11. The apparatus according to claim 7, wherein each one of said plurality of cartridges includes a door disposed on said cartridge and allows the utensils to be placed in each of said cartridges for use in said utensil transfer station.

12. The apparatus according to claim 1, said napkin folding station comprises:

a folding arm having at least one suction device disposed on its bottom surface for releasably engaging the napkin;

a vacuum lift for raising and lowering the folding arm; and a shifter assembly for allowing the folding arm to manipulate the napkin.

13. An apparatus for wrapping a napkin around one or more utensils comprising:

a generally rectangular shaped, hollow housing having an output opening, a utensil input access door and a napkin input access door;

a support frame, positioned inside of said housing, having an assembly of vertically disposed beams and horizontally disposed support rails;

a napkin lifting station for receiving and supporting a stack of napkins, the napkins being placed onto said lifting station through said napkin input access door, said lifting station having a platform, with a flat top, a plurality of supports and a platform lift for incrementally lifting said platform after a predetermined amount of napkins are removed from the stack;

a napkin wrapping station for wrapping a napkin around a predetermined amount of utensils, having a pair of sidewalls, an output conveyor belt disposed between said pair of sidewalls, a pair of counter-rotating napkin wrapping belts, a wrapping carriage having a plurality of winding rollers, a wrapping carriage shifter assembly and a plurality of actuators for operating said napkin wrapping station;

a napkin transfer station for individually transferring napkins from said napkin lifting station to said napkin wrapping station, having a base plate with a flat bottom surface, a plurality of suction devices disposed on the bottom surface of the base plate, a height adapter for raising and lowering the base plate, a pair of guide rails and a shifter assembly for repositioning the base plate along the guide rails;

a utensil transfer station for simultaneously placing a plurality of types of utensils onto an individual napkin while the napkin is positioned on said napkin wrapping station, said utensil transfer station having a plurality of cartridges for sortingly storing a plurality of types of utensils, a plurality of lifters for lifting each of the stacks of utensil out of the cartridges, a plurality of utensils grippers for removing individual utensils from the cartridges, a utensil shifter assembly for lifting and transporting the utensils onto the napkins and a bracket for mounting said utensil transfer station to said support frame; and a napkin folding station for folding over corners of a napkin prior to being wrapped by said wrapping station, having a folding arm with a suction device disposed on its bottom surface for releasably engaging the napkin and a shifting assembly for allowing the folding arm to manipulate the napkin;

said napkin lifting station, napkin wrapping station, napkin transfer station, napkin folding station and utensil transfer station are each disposed on said support frame;

wherein upon receiving a predetermined amount of utensils from said utensil transfer station, and depositing the predetermined amount of utensils on the napkin at said napkin wrapping station, the predetermined amount of utensils are automatically wrapped in the napkin.

* * * * *